US012098553B2

(12) United States Patent
Jackson

(10) Patent No.: US 12,098,553 B2
(45) **Date of Patent: *Sep. 24, 2024**

(54) PANEL COUPLING AND ROTATION SYSTEM

(71) Applicant: JACKSON DESIGN & REMODELING, INC., San Diego, CA (US)

(72) Inventor: Todd Raymond Jackson, San Diego, CA (US)

(73) Assignee: JACKSON DESIGN & REMODELING, INC., San Diego, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/466,574

(22) Filed: Sep. 13, 2023

(65) Prior Publication Data

US 2024/0003137 A1 Jan. 4, 2024

Related U.S. Application Data

(63) Continuation of application No. 17/506,159, filed on Oct. 20, 2021, now Pat. No. 11,795,698.

(51) Int. Cl.
*E04F 10/10* (2006.01)

(52) U.S. Cl.
CPC ..... *E04F 10/10* (2013.01)

(58) Field of Classification Search
CPC ..... E04F 10/10
See application file for complete search history.

(56) References Cited

U.S. PATENT DOCUMENTS

| | | | | |
|---|---|---|---|---|
| 3,748,461 | A | 7/1973 | Wilson et al. | |
| 6,363,662 | B1 | 4/2002 | Coates | |
| 6,536,165 | B2 | 3/2003 | Pilcher | |
| 6,572,239 | B1 | 6/2003 | Harbin | |
| 6,918,680 | B2 | 7/2005 | Seeberger | |
| 6,955,458 | B2 | 10/2005 | Cheema | |
| 7,344,265 | B1 | 3/2008 | Tieken | |
| 8,956,000 | B2 | 2/2015 | Martinez | |
| 9,422,715 | B1 | 8/2016 | Selzer | |
| 11,149,438 | B2 | 10/2021 | Torman et al. | |
| 11,795,698 | B2 * | 10/2023 | Jackson | E04F 10/10 |
| 2005/0225982 | A1 | 10/2005 | Hahn | |

(Continued)

*Primary Examiner* — Beth A Stephan
(74) *Attorney, Agent, or Firm* — PILLSBURY WINTHROP SHAW PITTMAN LLP; Peter K. Hahn; Jeffrey T. Sheriff

(57) ABSTRACT

This disclosure relates to a patio cover system. The system comprises a frame comprising support beams; support posts configured to support the frame; cover panels rotatably coupled to the support beams; an actuator, and/or other components. The actuator may be mounted to the frame and coupled to the cover panels, may be configured to rotate the cover panels between an open configuration and a closed configuration, and comprises a motor; a piston coupled to the motor; an arm coupled to the piston and configured to extend from the piston toward the cover panels; a linking member coupled to the arm and the cover panels, and/or other components. The linking member may be configured to rotate the cover panels in unison between the open configuration and the closed configuration when driven by the arm, the piston, and/or the motor.

10 Claims, 7 Drawing Sheets

(56) References Cited

U.S. PATENT DOCUMENTS

| | | | |
|---|---|---|---|
| 2013/0291438 | A1 | 11/2013 | Selzer |
| 2014/0175240 | A1 | 6/2014 | Selzer |
| 2019/0338528 | A1 | 11/2019 | Torman et al. |
| 2021/0363752 | A1 | 11/2021 | Wagaman et al. |

* cited by examiner

PANEL COUPLING AND ROTATION SYSTEM

CROSS-REFERENCE TO RELATED APPLICATION

This present application is a continuation of U.S. patent application Ser. No. 17/506,159, filed Oct. 20, 2021, entitled "PANEL COUPLING AND ROTATION SYSTEM", which is being incorporated herein by reference.

FIELD OF THE DISCLOSURE

This disclosure relates to a panel coupling and rotation system.

BACKGROUND

Louvered patio covers are known. Louvered patio covers are often installed over an area designed for seating, tables, and/or other objects, to create an outdoor living space. Louvered patio covers are designed to be aesthetically pleasing, and function as at least a partial shelter from the ambient environment.

SUMMARY

One aspect of the disclosure relates to a patio cover system. The system comprises a frame comprising support beams; support posts configured to support the frame; cover panels rotatably coupled to the support beams; an actuator mounted to the frame and coupled to the cover panels, and/or other components. The actuator may be configured to rotate the cover panels between an open configuration and a closed configuration, The actuator comprises: a motor; a piston coupled to the motor; an arm coupled to the piston and configured to extend from the piston toward the cover panels; a linking member coupled to the arm and the cover panels, and/or other components. The linking member may be configured to rotate the cover panels in unison between the open configuration and the closed configuration when driven by the arm, the piston, the motor, and/or other components.

In some implementations, the linking member may be rotatably coupled to a plurality of individual link pins that extend from different ones of the cover panels. The linking member may be configured to rotate the cover panels between the open configuration and the closed configuration via the link pins.

In some implementations, a given link pin may extend from one side of a cover panel at an end of the cover panel such that at least a portion of the linking member and/or the arm changes height relative to the frame when the cover panels rotate between the open configuration and the closed configuration.

In some implementations, the cover panels may be mounted to the frame via rotation pins located at either end of a given cover panel. The rotation pins may be located along an axis of rotation of the given cover panel. The rotation pins may be separate from the link pins.

In some implementations, the linking member may comprise arcuate portions configured to engage the rotation pins when the cover panels are in the closed configuration.

In some implementations, the motor may be pivotally coupled to the frame to allow the motor and the piston to pivot toward the frame when the cover panels rotate to the closed configuration, and pivot away from the frame when the cover panels rotate to the open configuration.

In some implementations, the arm may be configured to couple with the piston at a location above the cover panels, the linking member, and the frame such that intended movement of the piston and/or the motor is not interrupted by the cover panels, the linking member, and/or the frame.

In some implementations, the linking member may be coupled to the cover panels at a gap between corresponding ends of the cover panels and the frame. The linking member may be positioned in the gap when the cover panels are in the closed configuration. The linking member may be positioned above the gap when the cover panels are in the open configuration.

In some implementations, the linking member may be longer than the arm along a first axis, and the arm may be longer than the linking member along a second, substantially perpendicular axis. The arm may have a longer first end located toward the motor along the first axis relative to a shorter second, opposite, end of the arm.

In some implementations, the cover panels may be louvered.

Another aspect of the disclosure relates to an actuator for a patio cover system. The actuator comprises a motor; and a linking assembly coupled to the motor and configured to rotate cover panels of the patio cover system between an open configuration and a closed configuration.

In some implementations, the linking assembly comprises: a piston coupled to the motor; an arm coupled to the motor or the piston and configured to extend toward the patio cover panels; and/or a linking member coupled to the motor, the piston, or the arm, and the cover panels, the linking member configured to rotate the cover panels in unison when driven by the arm, the piston, and/or the motor, between the open configuration and the closed configuration.

In some implementations, the linking member may be rotatably coupled to a plurality of individual link pins that extend from different ones of the cover panels. The linking member may be configured to rotate the cover panels between the open configuration and the closed configuration via the link pins.

In some implementations, a given link pin may extend from one side of a cover panel at an end of the cover panel such that at least a portion of the linking member and/or the arm changes height relative to a frame of the patio cover system when the cover panels rotate between the open configuration and the closed configuration.

In some implementations, the cover panels may be mounted to the frame via rotation pins located at either end of a given cover panel. The rotation pins may be located along an axis of rotation of the given cover panel. The rotation pins may be separate from the link pins.

In some implementations, the linking member may comprise arcuate portions configured to engage the rotation pins when the cover panels are in the closed configuration.

In some implementations, the motor may be pivotally coupled to a frame of the patio cover system to allow the motor and the piston to pivot toward the frame when the cover panels rotate to the closed configuration, and pivot away from the frame when the cover panels rotate to the open configuration.

In some implementations, the arm may be configured to couple with the piston at a location above the cover panels, the linking member, and a frame of the patio cover system such that intended movement of the piston and/or the motor is not interrupted by the cover panels, the linking member, and/or the frame.

In some implementations, the linking member may be coupled to the cover panels at a gap between corresponding ends of the cover panels and a frame of the patio cover system. The linking member may be positioned in the gap when the cover panels are in the closed configuration. The linking member may be positioned above the gap when the cover panels are in the open configuration.

In some implementations, the linking member may be longer than the arm along a first axis. The arm may be longer than the linking member along a second, substantially perpendicular axis. The arm may have a longer first end located toward the motor along the first axis relative to a shorter second, opposite, end of the arm.

In some implementations, the cover panels may be louvered.

These and other features, and characteristics of the present technology, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and in the claims, the singular form of "a", "an", and "the" include plural referents unless the context clearly dictates otherwise.

DETAILED DESCRIPTION

Figure 1:
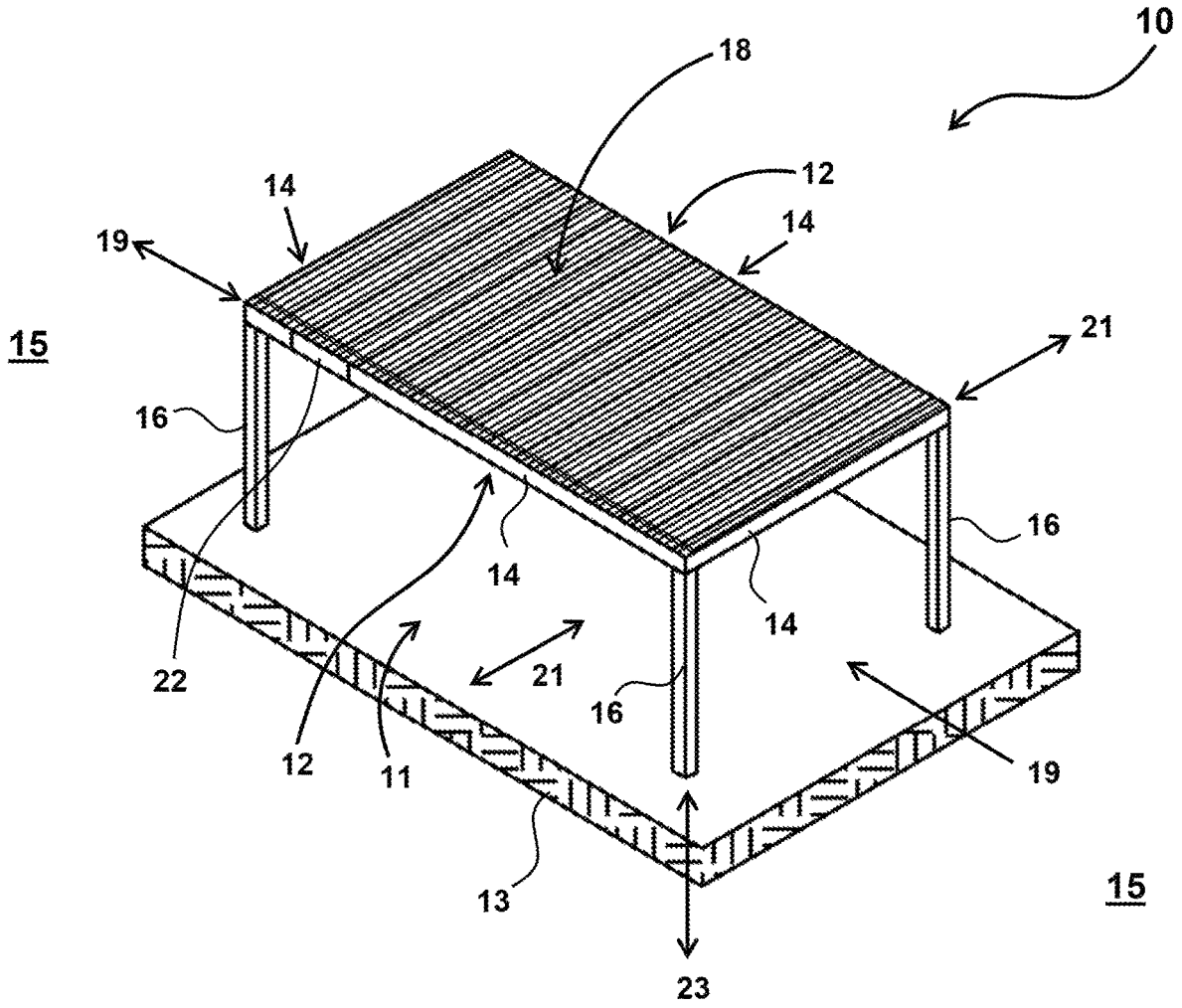
FIG. 1 illustrates a patio cover system, in accordance with one or more implementations.

In the following paragraphs, implementations of the present disclosure will be described in detail by way of example with reference to the accompanying drawings, which are not necessarily drawn to scale, and the illustrated components are not necessarily drawn proportionately to one another. Throughout this description, the implementations and examples shown should be considered as exemplars, rather than as limitations on the present disclosure. As used herein, the "present disclosure" refers to any one of the implementations of the disclosure described herein, and any equivalents. Furthermore, reference to various aspects of the disclosure throughout this document does not mean that all claimed implementations or methods must include the referenced aspects.

As used herein, the singular form of "a", "an", and "the" include plural references unless the context clearly dictates otherwise. As used herein, the statement that two or more parts or components are "coupled" shall mean that the parts are joined or operate together either directly or indirectly, i.e., through one or more intermediate parts or components, so long as a link occurs. As used herein, "directly coupled" means that two elements are directly in contact with each other. As used herein, "fixedly coupled" or "fixed" means that two components are coupled so as to move as one while maintaining a constant orientation relative to each other.

As employed herein, the statement that two or more parts or components "engage" one another shall mean that the parts exert a force against one another either directly or through one or more intermediate parts or components. Directional phrases used herein, such as, for example and without limitation, top, bottom, left, right, upper, lower, front, back, above, below, and derivatives thereof, relate to the orientation of the elements shown in the drawings and are not limiting upon the claims unless expressly recited therein.

FIG. 1 illustrates a patio cover system 10. Patio cover system 10 is illustrated installed over an area 11 designed for seating, tables, and/or other objects, to create an outdoor living space. In the example shown in FIG. 1, patio cover system 10 is shown installed over a patio 13. Patio 13 may be formed from cement and/or concrete, wood, earth, grass, gravel, and/or other materials. Patio cover system 10 may be configured to be aesthetically pleasing, and function as at least a partial shelter from the ambient environment 15. Patio cover system 10 may include support beams 14 configured to form a frame 12. Patio cover system 10 may comprise frame 12, support posts 16, cover panels 18, an actuator 22, and/or other components.

Frame 12 may be and/or form a support structure for cover panels 18, actuator 22, and/or other components of patio cover system 10. In some implementations, frame 12 may form a perimeter of patio cover system 10. Frame 12 may have a generally rectangular shape (e.g., as shown in FIG. 1) and/or other shapes. Frame 12 may be formed by a plurality of support beams 14 and/or other components. Frame 12 may be formed by coupling the ends of support beams 14 together. For example, as shown in FIG. 1, four support beams 14 may be coupled together to form the generally rectangular shape of frame 12. Continuing with this example, an individual support beam 14 may be coupled to two other support beams 14, one at either end of the individual support beam 14. Frames 12 having other quantities of support beams 14 joined to form the same (e.g., generally rectangular) or other frame 12 shapes (e.g. generally square, triangular, pentagonal, hexagonal, octagonal, etc.) are contemplated.

As described above, support beams 14 may be coupled together to form frame 12 and/or be used for other purposes. In some implementations, support beams 14 may have a length that extends along a primary longitudinal axis 19 or 21 and a thickness that extends along a secondary transverse axis (not specifically labeled in FIG. 1). In some implementations (e.g., when frame 12 has a generally rectangular shape), pairs of support beams 14 may have substantially the same length, with a first pair having a length that is longer than a length of a second pair of support beams 14. These pairs of support beams 14 may be coupled to form a rectangle (e.g., as illustrated in FIG. 1), with beams of the same length on opposite sides of the rectangle. In some implementations (e.g., when frame 12 has a generally square and/or other shapes), support beams 14 may have the same length. In some implementations, support beams 14 may have a rectangular cross section and/or other cross sections. In some implementations, support beams 14 may be solid or hollow. In some implementations, support beams 14 may be partially hollow. For example, support beams 14 may have hollow ends and/or other hollow areas. In some implementations, support beams 14 may be formed from metal, wood, polymers, and/or other materials.

Support posts 16 may be configured to support frame 12 and/or other components. Support posts 16 may be vertically oriented, for example, and/or have other orientations. Support posts 16 may be fixedly or movably coupled to a patio 13, a ground surface, and/or any other support surface. In some implementations, support posts 16 may rest on patio 13, a ground surface, or another support surface without being fixedly or movably coupled to such a surface. In some implementations, support posts 16 may have a length that extends along a primary longitudinal axis 23 and a thickness that extends along a secondary transverse axis (not specifically labeled in FIG. 1). In some implementations (e.g., when frame 12 has a generally rectangular shape), support posts 16 may include four support posts 16 having substantially the same length. Support posts 16 may be positioned at or near the corners of the generally rectangular shape formed by frame 12 (e.g., as illustrated in FIG. 1). In some implementations (e.g., when frame 12 has a generally triangular and/or other shapes), more or less support posts 16 of one or more lengths may be required. In some implementations, support posts 16 may have a generally square cross section, rectangular cross section, and/or other cross sections. In some implementations, support posts 16 may be solid or hollow. In some implementations, support posts 16 may be formed from metal, wood, polymers, and/or other materials.

Beams 14 and/or posts 16 may be coupled together. Beams 14 and/or posts 16 may be coupled via one or more coupling devices and/or other components. In some implementations, the one or more coupling devices may include screws, nuts, bolts, adhesive, washers, fittings, bearings, slots, hooks, clamps, clips, nails, complimentary alignment features, friction fits, brackets, and/or other coupling components. The coupling devices may be located at or near the (upper) ends of support posts 16, opposite a ground or patio 13 surface, and/or in other locations. In the example shown in FIG. 1, coupling devices may be located at or near the corners of frame 12, proximate to support posts 16. In some implementations, coupling devices may directly couple beams 14 to each other and/or support posts 16. In some implementations, coupling devices may indirectly couple beams 14 to each other and/or support posts 16 via other components.

Support beams 14 may be hollow, or partially hollow (e.g., hollow ends), and have a rectangular cross section and/or other cross sections. Support beams 14 may also have perpendicular ends, angled ends, and/or other features. An angled end may comprise an end surface (or outline of a surface for hollow beams) of a support beam 14 that is not perpendicular to an elongated body (e.g., elongated along axis 19 or 21 shown in FIG. 1) of the support beam 14. Perpendicular and/or angled ends of different support beams 14 may face, meet, and/or abut each other when coupled together and/or coupled to a support post 16.

Cover panels 18 may be configured to block or reduce an amount of ambient light that passes through frame 12 into an interior of patio cover system 10. Cover panels 18 may be louvered and/or have other shapes. Cover panels 18 may be configured to at least partially block elements (e.g., light, precipitation, wind, etc.) of the ambient environment from reaching the interior of patio cover system 10. Cover panels 18 may be opaque, translucent, and/or transparent. Cover panels 18 may be formed from polymers, wood, metal, and/or other materials. Individual cover panels 18 may be configured to be suspended (e.g., in parallel) between support beams 14 across frame 12, above the interior of patio cover system 10. Cover panels 18 may be rotatably coupled to support beams 14 so that cover panels 18 may rotate relative to support beams 14. In some implementations, cover panels 18 may have an elongated, generally rectangular shape, and/or other shapes. Cover panels 18 may be rotatably coupled to support beams 14 at either and/or both ends of a given cover panel 18. Patio cover system 10 may be configured with any number of cover panels 18, having any dimensions that allow patio cover system 10 to function as described herein.

Actuator 22 may be mounted to frame 12 and/or other portions of patio cover system 10, and coupled to cover panels 18. Actuator 22 may be configured to rotate cover panels 18 between an open configuration and a closed configuration (and/or intermediate configurations between the open configuration and the closed configuration). Actuator 22 may be configured such that the open configuration allows ambient light (and/or other elements of the ambient environment) to pass between cover panels 18, and the closed configuration blocks light (and/or the other elements of the ambient environment) from passing between cover panels 18. In some implementations, actuator 22 may be configured to rotate individual cover panels 18 in unison between the open configuration and the closed configuration.

Actuator 22 may be mounted to frame 12 in any location that facilitates coupling with cover panels 18. In some implementations, actuator 22 may be coupled to cover panels 18 via one or more actuator components. In some implementations, the one or more actuator components may include rotating joints, bearings, hinges, and/or other components that facilitate coupling actuator 22 to cover panels 18 and/or movement of cover panels 18 by actuator 22. In some implementations, actuator 22 comprises a motor, a piston, an arm, a linking member, and/or other components. Each of these components is illustrated in various figures and described below.

Figure 2A:
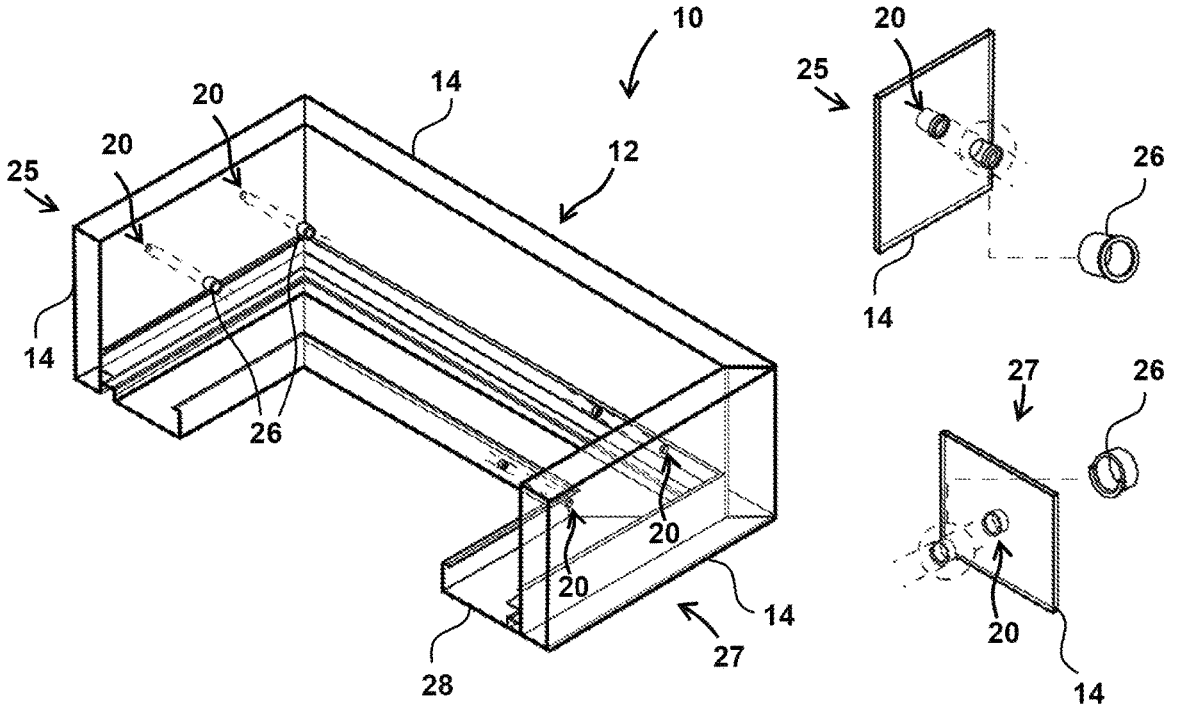
FIG. 2A illustrates aspects of mounting louvered cover panels to a frame of the patio cover system, in accordance with one or more implementations.
Figure 2B:
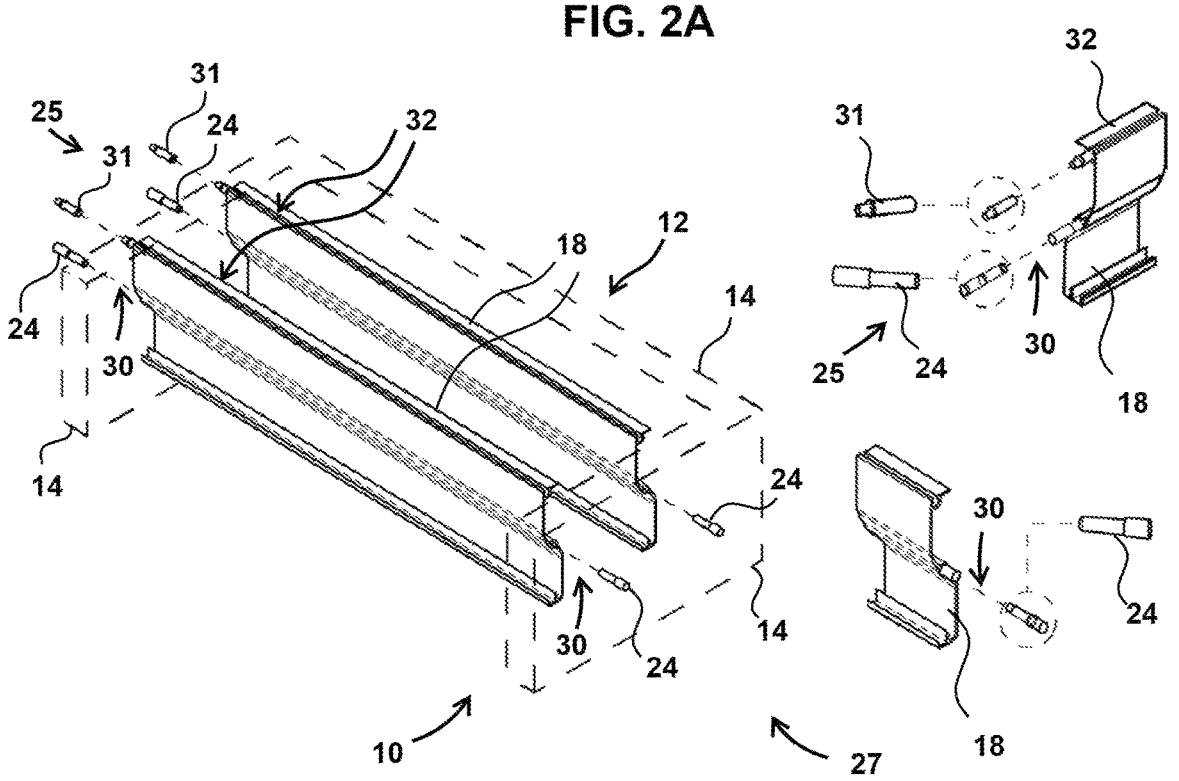
FIG. 2B illustrates additional aspects of mounting the louvered cover panels to the frame of the patio cover system, in accordance with one or more implementations.

FIGS. 2A and 2B illustrate aspects of mounting cover panels 18 mounted to frame 12. As shown in FIG. 2A, beams 14 on opposite sides 25, 27 of frame 12 may include one or more corresponding orifices 20, and/or other features. Orifices 20 may be configured (e.g., located, sized, shaped, spaced, etc.) such that panels 18 may be mounted to frame 12 via orifices 20. Orifices 20 may be configured to receive bushings 26 and/or other components. Bushings 26 and/or other components may be configured to reduce friction of panels 18 in frame 12, enhance alignment of panels 18 in frame 12, and/or have other purposes. In some implementations, such as when actuator 22 is mounted to one side 25 of frame 12 (e.g., as shown and described below) bushings 26 may be different depending on the side 25, 27 of frame 12 in which bushings 26 are used. For example, a shoulder bushing 26 may be used on side 27, while a standard bushing 26 may be used on side 25 (e.g., the side where actuator 22 is mounted). (Note that FIG. 2A also illustrates an optional gutter 28 that may be coupled to frame 12.)

As shown in FIG. 2B, panels 18 may be louvered. Panels 18 may be mounted to frame 12 via rotation pins 24 located at either end of a given panel 18. Rotation pins 24 may be located along an axis of rotation 30 of the given panel 18. Rotation pins 24 may be made of metal, polymers, ceramics, and/or other materials. For example, rotation pins 24 may be made of aluminum and/or other materials. Rotation pins 24 may have one end press fit into a receiving portion of a panel 18, and an opposite end configured for rotational engagement with an orifice 20 and/or bushing 26.

FIG. 2B also illustrates a plurality of individual link pins 31 that extend from different ones of the cover panels 18. Link pins 31 may be located toward an outer edge 32 of a given panel 18. Link pins 31 may be made of metal, polymers, ceramics, and/or other materials. For example, link pins 31 may be made of Delrin, and/or other materials. Link pins 31 may have one end press fit into a receiving portion of a panel 18, and an opposite end configured for rotational engagement with a linking member (not shown in FIG. 2A or 2B) and/or other components of system 10. Link pins 31 are further described below.

Figure 3A:
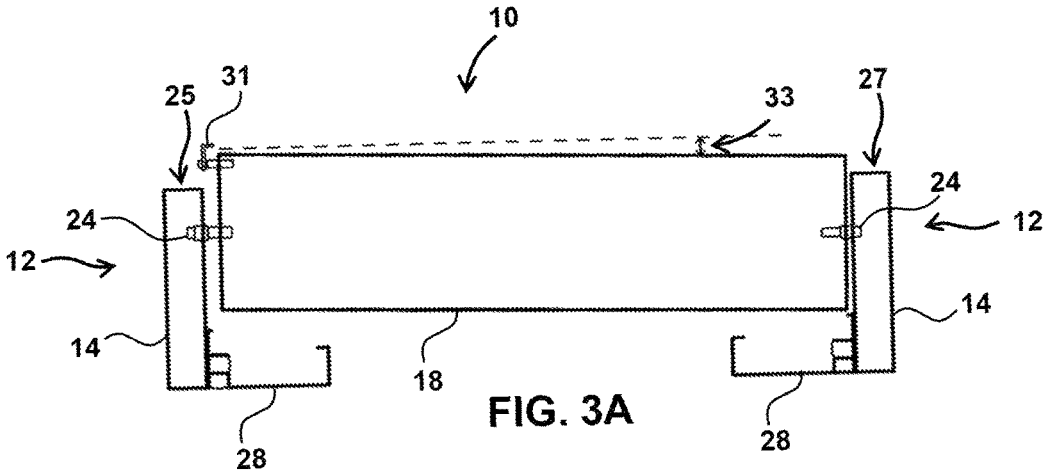
FIG. 3A illustrates how individual panels may be mounted in the frame at an angle relative to beams of the frame, in accordance with one or more implementations.

FIG. 3A-3E illustrate additional aspects of mounting panels 18 to frame 12. For example, FIG. 3A illustrates how, in some implementations, individual panels 18 may be mounted in frame 12 at a (e.g., non-parallel or perpendicular) angle 33 relative to (e.g., top, or upper surfaces of) beams 14. For example, orifices 20 that receive rotation pins 24 may be located closer to an upper surface of a beam 14 on side 25 relative to side 27 (e.g., the side of frame 12 where actuator 22 is mounted, as described herein). Mounting panels 18 at angle 33 may facilitate drainage, enhance coupling between panels 18 and other components of actuator 22, and/or have other purposes.

Figure 3B:
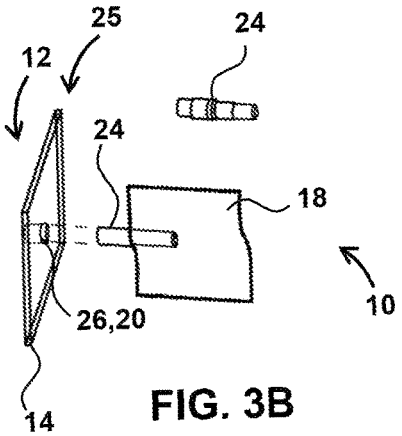
FIG. 3B illustrates inserting a pin from a cover panel into a corresponding orifice and/or bushing at an end of the frame, in accordance with one or more implementations.

FIG. 3B illustrates inserting a rotation pin 24 into a corresponding orifice 20 and/or bushing 26 at side 25 of frame 12. FIG. 3C illustrates inserting a rotation pin 24 at an opposite end of a panel 18 into a corresponding orifice and/or bushing 26 at side 27 of frame 12; and attaching a snap ring 34 to a rotation pin 24 at side 25 of frame 12. In some implementations, the inserting shown in FIGS. 3B and 3C comprises pressing a pin 24 into an orifice 20 and/or a bushing 26. In some implementations, snap ring 34 may be configured to maintain a desired spacing between a panel 18 and a beam 14, and/or may be configured for other purposes. In some implementations, pins 24 at either end of a panel 18 may be the same or different. In some implementations, different pins 24 (e.g., different length pins 24) at either end of a panel 18 may facilitate assembly of frame 12 before assembly of other components of the present system, and/or have other purposes.

Figure 3E:
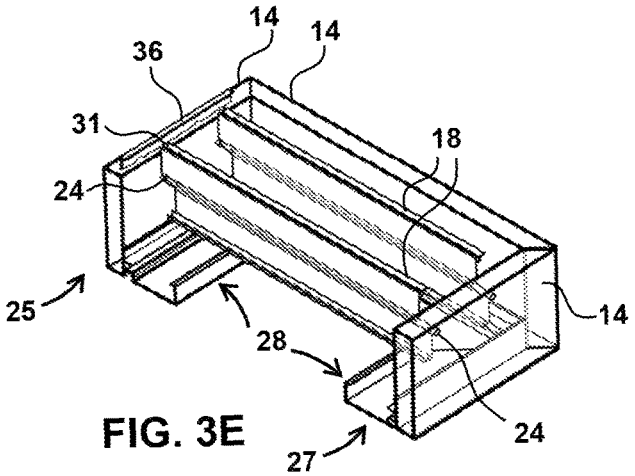
FIG. 3E illustrates cover panels installed in the frame, in accordance with one or more implementations.
Figure 3C:
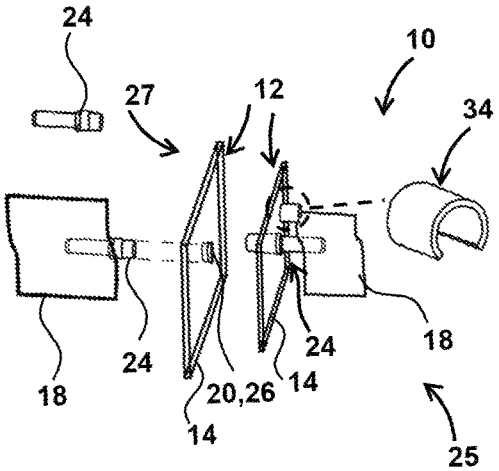
FIG. 3C illustrates inserting a pin at an opposite end of a cover panel into a corresponding orifice and/or bushing at an opposite end of the frame; and attaching a snap ring to a pin; in accordance with one or more implementations.
Figure 3D:
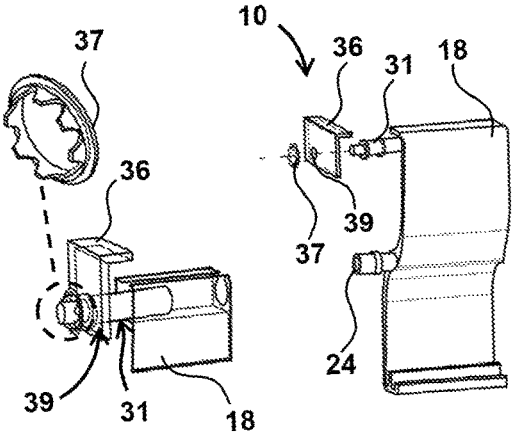
FIG. 3D illustrates coupling a link pin to a linking member, in accordance with one or more implementations.

FIG. 3D illustrates coupling a link pin 31 to a linking member 36. Linking member 36 is further described below. One end of link pin 31 may be inserted into and/or otherwise coupled with a panel 18 as described above. An opposite end of link pin 31 may be coupled with linking member 36 via one or more coupling devices such as a retainer 37 (as shown in this example), screws, nuts, bolts, adhesive, washers, fittings, bearings, slots, hooks, clamps, clips, nails, complimentary alignment features, friction fits, brackets, and/or other coupling devices. Link pin 31 may be coupled to linking member 36 such that there is a relative freedom of movement between link pin 31 and linking member 36. For example, as shown in FIG. 3D, a link pin 31 may pass through an orifice 39 in linking member 36 and be coupled to linking member 36 by attaching retainer 37 to a side of link pin 31 that has passed through orifice 39. Repeating this connection, or similar connections, between different panels 18 and linking member 36, at different orifices 39, may facilitate simultaneous rotation of individual panels 18.

FIG. 3E illustrates panels 18 installed in frame 12. FIG. 3E illustrates rotation pins 24 coupled to beams 14 on sides 25 and 27 of frame 12, and link pins 31 coupled to linking member 36 on side 25 of frame 12. FIG. 3E may illustrate, for example, an additive combination of the components shown in FIG. 2A-FIG. 3D and described above.

Figure 4A:
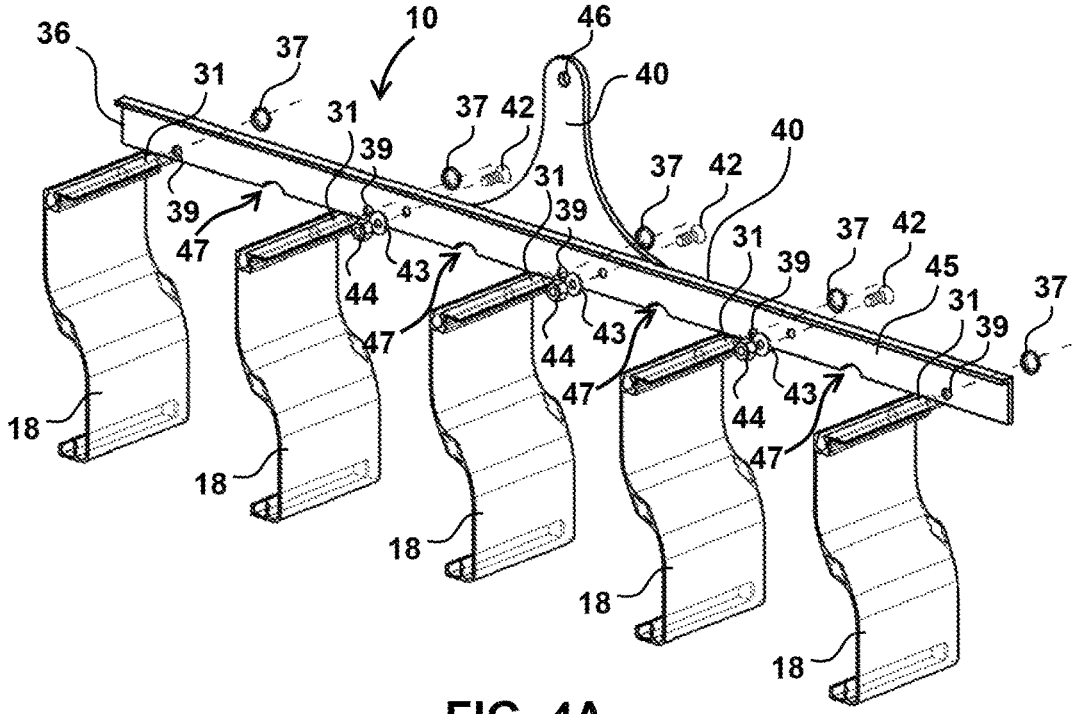
FIG. 4A illustrates the linking member, an arm, and cover panels, in accordance with one or more implementations.
Figure 4B:
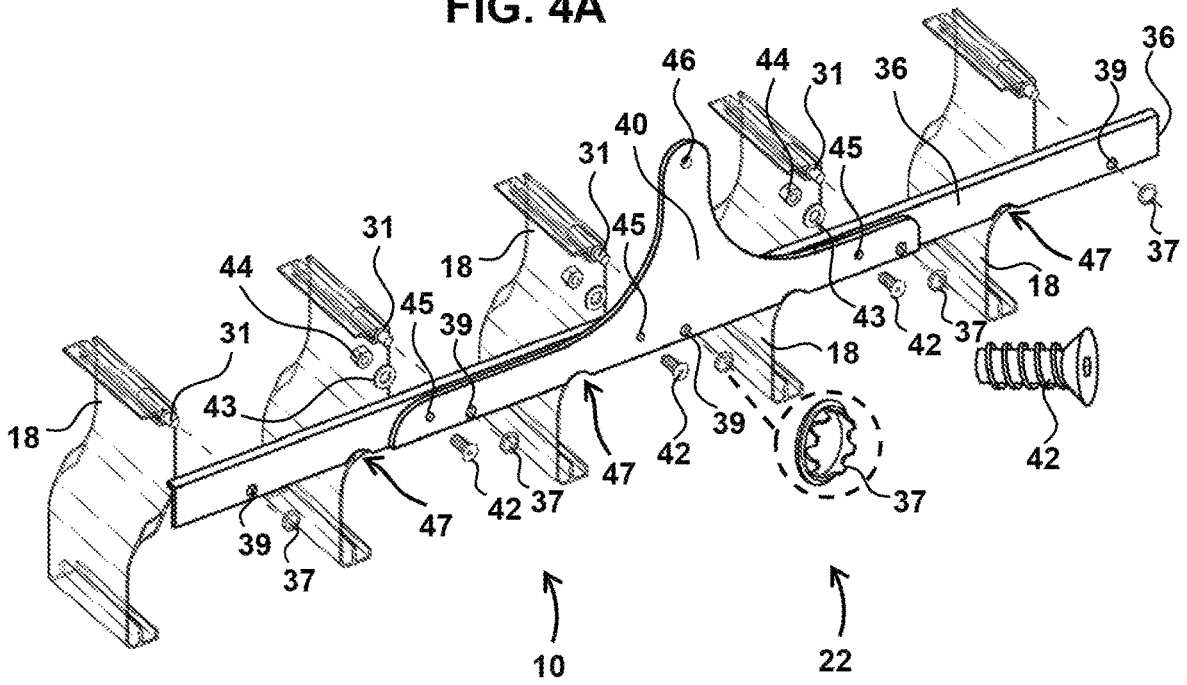
FIG. 4B also illustrates the linking member, the arm, and cover panels, in accordance with one or more implementations.

FIGS. 4A and 4B illustrate linking member 36, an arm 40, panels 18, and other components of actuator 22 and/or system 10. FIGS. 4A and 4B illustrate linking member 36, arm 40, panels 18, and other components of actuator 22 and/or system 10 from opposite sides. Linking member 36 may be coupled to arm 40, panels 18, and/or other components. In some implementations, linking member 36 may be coupled to arm 40, panels 18, and/or other components of system 10 using various coupling devices. The coupling devices may include screws, nuts, bolts, adhesive, washers, fittings, bearings, slots, hooks, clamps, clips, nails, complimentary alignment features, friction fits, brackets, and/or other coupling devices. For example, as shown in FIGS. 4A and 4B, linking member 36 may be coupled to arm 40 using one or more flat socket cap stainless steel bolts 42, flat washers 43, nylon lock nuts 44, and/or other components. Linking member 36 may be coupled to arm 40 using these and other components at one or more corresponding orifices 45 in linking member 36 and arm 40. In some implementations, orifices 45 may be different than orifices 39 (e.g., linking member 36 and arm 40 may also include corresponding orifices 39), which are configured to receive linking pins 31 as described above.

Linking member 36 may be configured to rotate panels 18 in unison between the open configuration and the closed configuration when driven by arm 40, a piston (described below), a motor (described below), and/or other components of actuator 22. Linking member 36 may comprise arcuate portions 47 configured to engage rotation pins 24 (FIG. 2B, 3B, 3C, 3D) when cover panels 18 are in the closed configuration. In some implementations, this engagement may prevent panels 18 from over rotating, and/or damaging other components of system 10. In some implementations, arm 40 may comprise corresponding arcuate portions 47 such that when arm 40 and linking member 36 are coupled, arcuate portions 47 of arm 40 and linking member 36 overlap as shown in FIGS. 4A and 4B.

Figure 5A:
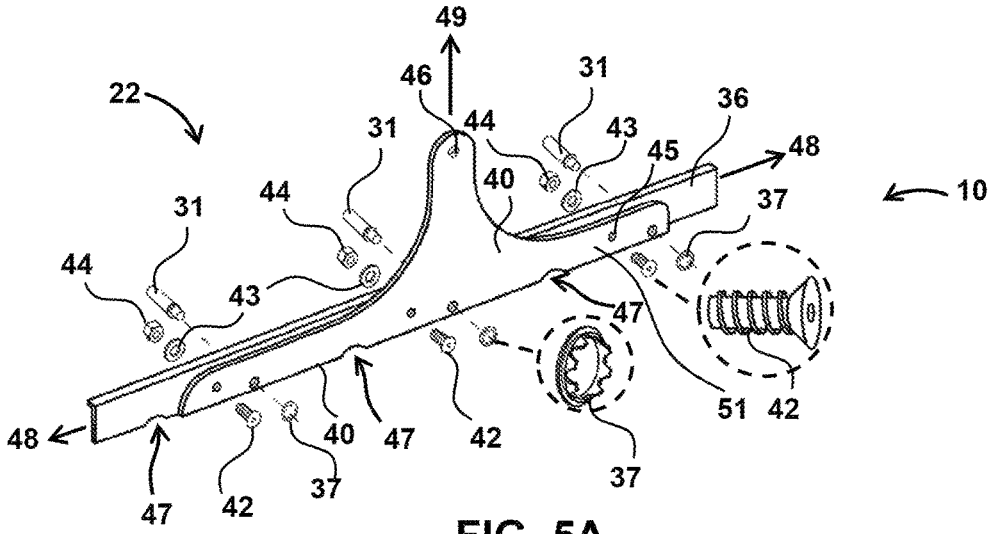
FIG. 5A illustrates the linking member and the arm, in accordance with one or more implementations.

FIG. 5A illustrates (or re-illustrates) linking member 36 and arm 40. As shown in FIG. 5A, in some implementations, linking member 36 may be longer than arm 40 along a first axis 48. Arm 40 may be longer than linking member 36 along a second, substantially perpendicular axis 49. In some implementations, linking member 36 may have an elongated substantially rectangular shape along axis 48. In some implementations, linking member 36 may have a rectangular cross section and/or other cross-sectional shapes. In some implementations, linking member 36 may have a shape that is different than the shape of linking member 36 shown in the present figures, may include one or more sub portions coupled to other sub portions, and/or have other configurations. In some implementations, the shape, size, material, and/or other characteristics of linking member 36 may be configured to provide sufficient rigidity such that, when link pins 31 are coupled to linking member 36, linking member 36 can move a plurality of panels 18 between the open configuration and the closed configuration in unison.

In some implementations, arm 40 may be elongated along axis 48 and/or axis 49. Arm 40 may be formed with one or more arcuate surfaces extending between axis 48 and axis 49. In some implementations, arm 40 may have a longer first end 50 located along axis 48 relative to a shorter second, opposite, end 51 of arm 40. In some implementations, arm 40 may have a shape that is different than the shape of arm 40 shown in the present figures, may include one or more sub portions coupled to other sub portions, and/or have other configurations. In some implementations, the shape, size, material, and/or other characteristics of arm 40 may be configured to provide sufficient rigidity such that, when arm 40 is coupled to linking member 36, the piston (not shown in FIG. 5A), and/or the motor (not shown in FIG. 5A), arm 40 can move linking member 36 (which is coupled to panels 18 as described herein). In some implementations, arm 40 and linking member 36 may form a single unitary piece.

Figure 5B:
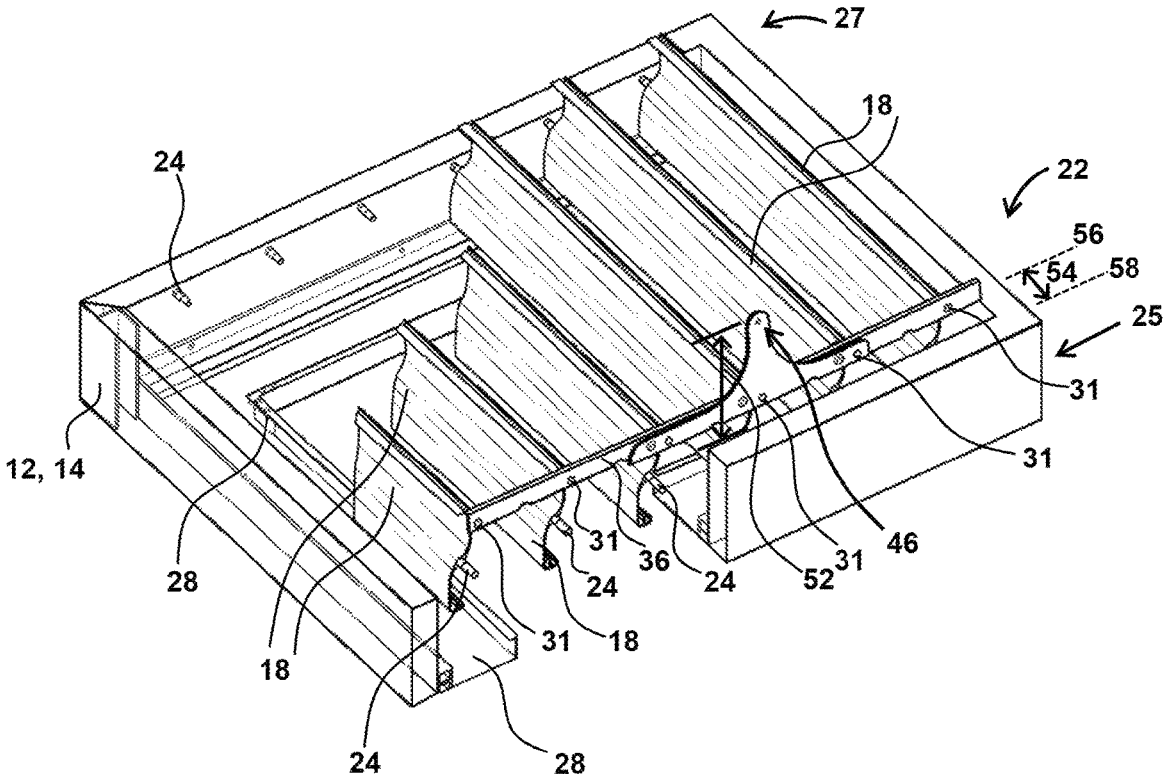
FIG. 5B illustrates the linking member and the arm, in relation to other components of the system including cover panels, the frame, the beams, and/or other components, in accordance with one or more implementations.

FIG. 5B illustrates linking member 36 and arm 40, in relation to other components of actuator 22 and/or system 10 including cover panels 18, frame 12, beams 14, and/or other components. As shown in FIG. 5B, linking member 36 and/or arm 40 may be coupled to one side of panels 18 on side 25 of frame 12. In some implementations, the piston and/or the motor (not shown in FIG. 5B) may be coupled on this same side of frame 12. The piston and/or the motor may be coupled to arm 40 via one or more coupling features included in arm 40. In the example shown in FIGS. 5A and 5B, the coupling features comprise an orifice 46 located on one side of arm 40. Other features are contemplated. Arm 40 may be coupled to the piston, to the motor, and/or to other components. Arm 40 may be configured to extend away from panels 18 and/or linking member 36. This may be toward the piston and/or the motor, for example (or conversely, arm 40 may be configured to extend from the piston and/or or the motor toward linking member 36 and/or panels 18).

As described above, linking member 36 may be rotatably coupled to a plurality of individual link pins 31 that extend from different ones of the cover panels 18. Linking member 36 may be configured to rotate the panels 18 between the open configuration and the closed configuration via link pins 31. In some implementations, a given link pin 31 may extend from one side of a cover panel 18 at an end of the cover panel 18 such that at least a portion of linking member 36 and/or arm 40 changes height relative to frame 12 when cover panels 18 rotate between the open configuration (e.g., as shown in FIG. 5B) and the closed configuration.

In some implementations, linking member 36 may be coupled to panels 18 at a gap 54 between corresponding ends 56 of panels 18 and an edge 58 of frame 12 of patio cover system 10. Linking member 36 may be positioned in gap 54 when panels 18 are in the closed configuration. Linking member 36 may be positioned above gap 54 when panels 18 are in the open configuration (e.g., as shown in FIG. 5B).

Arm 40 may be configured to couple with the piston at a location 52 above (e.g., relative to a ground or support surface) panels 18, linking member 36, frame 12, and/or other components of system 10 such that intended movement of the piston and/or the motor is not interrupted by panels 18, linking member 36, frame 12 and/or other components of system 10. In some implementations, arm 40 may be configured to couple with the piston at a location below panels 18, linking member 36, frame 12, and/or other components of system 10 such that intended movement of the piston and/or the motor is not interrupted by panels 18, linking member 36, frame 12 and/or other components of system 10. This may be less aesthetically pleasing compared to coupling above these components, but nonetheless possible. This functionality is further illustrated and described below.

Figure 6C:
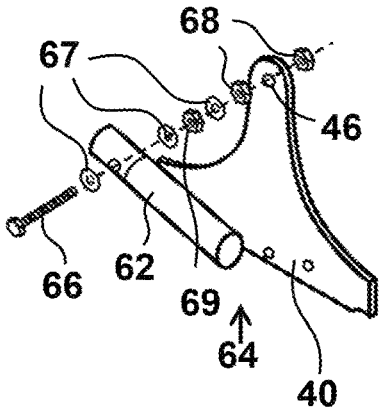
FIG. 6C illustrates an example of coupling the piston to the arm using a bracket, in accordance with one or more implementations.
Figure 6D:
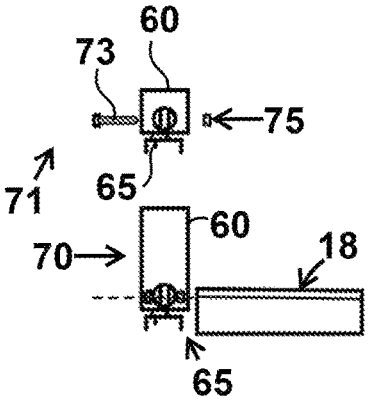
FIG. 6D illustrates two end views of a bracket used to couple the motor to the frame, in accordance with one or more implementations.
Figure 6E:
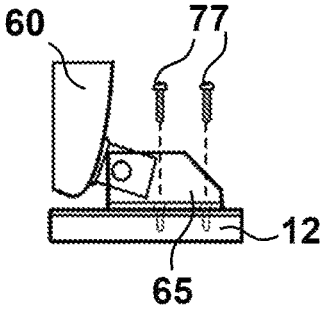
FIG. 6E illustrates a side view of the bracket used to couple the motor to the frame, in accordance with one or more implementations.
Figure 6B:
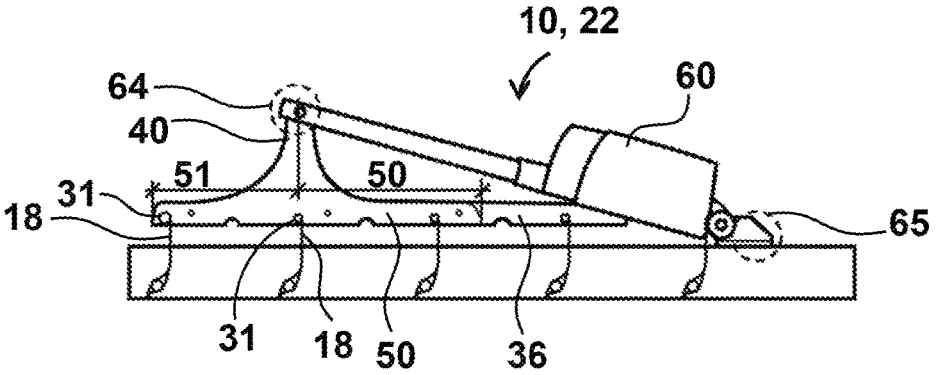
FIG. 6B illustrates a side view of the motor, the piston, the linking member, the arm, a portion of the frame, and portions of a plurality of cover panels, in accordance with one or more implementations.
Figure 6A:
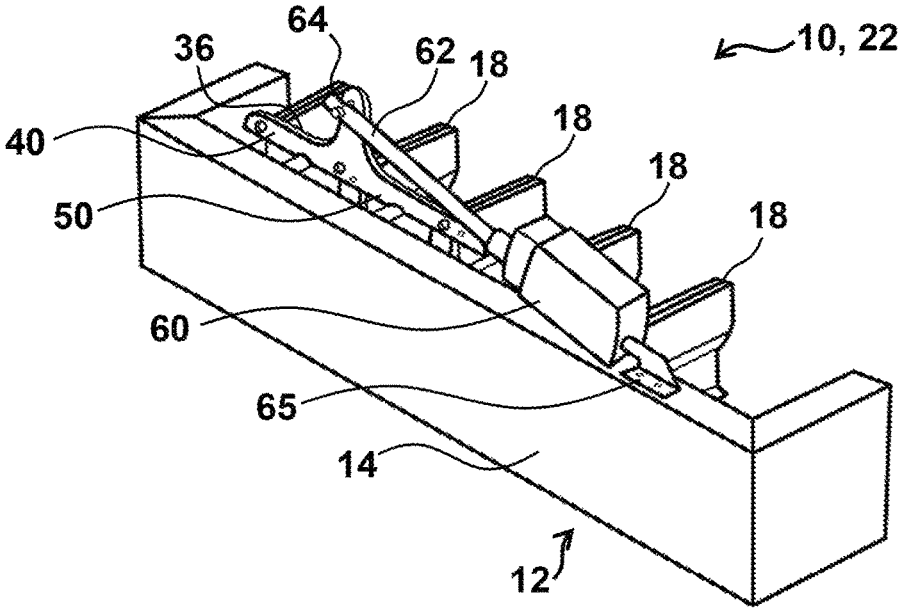
FIG. 6A illustrates a perspective view of a motor, a piston, the linking member, the arm, a portion of the frame, and portions of a plurality of cover panels, in accordance with one or more implementations.

FIG. 6A-6E illustrate a motor 60 (e.g., an example of the motor described above), a piston 62 (e.g., an example of the piston described above), linking member 36, arm 40, and/or other components of actuator 22 and/or system 10. FIG. 6A illustrates a perspective view of motor 60, piston 62, linking member 36, arm 40, a portion of frame 12, and portions of a plurality of panels 18. FIG. 6B illustrates a side view of motor 60, piston 62, linking member 36, arm 40, a portion of frame 12, and portions of a plurality of panels 18. As shown in FIGS. 6A and 6B, piston 62 may be coupled to arm 40, motor 60, and/or other components of actuator 22 and/or system 10. Piston 62 may be coupled to arm 40 using various coupling devices. The coupling devices may include screws, nuts, bolts, adhesive, washers, fittings, bearings, slots, hooks, clamps, clips, nails, complimentary alignment features, friction fits, brackets, and/or other coupling devices. For example, piston 62 may be coupled to arm 40 using a bracket 64 as shown in FIGS. 6A and 6B. Piston 62 may be configured to reciprocate between an extended portion and a retracted position to drive arm 40 and/or linking member 36 to move panels 18. Piston 62 may include a head and/or other components configured to move within an outer tube against a liquid or gas held by the tube to impart motion from motor 60 to arm 40 and/or linking member 36.

Motor 60 may be configured to drive piston 62, arm 40, linking member 36 and/or other components of actuator 22 and/or system 10 to move panels 18 between the open configuration and the closed configuration. Motor 60 may be an electric motor, for example, and/or other motors. Motor 60 may convert electrical energy to mechanical motion. In actuator 22 and/or system 10, motor 60 may supply motive power to piston 62, which in turn drives arm 40 and linking member 36, and/or other components of actuator 22 and/or system 10 to move panels 18. Motor 60 may include various coils, shafts, gears, and/or other components. In some implementations, motor 60 may be a linear motor, a rotary motor, and/or other motors. In some implementations, motor 60 may be and/or include a linear motor and/or other motors.

In some implementations, motor 60 is pivotally coupled to frame 12 to allow motor 60, piston 62, and/or other components of actuator 22 and/or system 10 to pivot toward frame 12 when panels 18 rotate to the closed configuration, and pivot away from frame 12 when panels 18 rotate to the open configuration. Motor 60 may be pivotally coupled to frame 12 using various coupling devices. The coupling devices may include screws, nuts, bolts, adhesive, washers, fittings, bearings, slots, hooks, clamps, clips, nails, complimentary alignment features, friction fits, a bracket, and/or other coupling devices. For example, as shown in FIGS. 6A and 6B, motor 60 may be coupled to frame 12 using a motor base bracket 65.

FIG. 6C illustrates an example of coupling piston 62 to arm 40 using a bracket 64. Bracket 64 may comprise various coupling devices. The coupling devices may include screws, nuts, bolts, adhesive, washers, fittings, bearings, slots, hooks, clamps, clips, nails, complimentary alignment features, friction fits, brackets, and/or other coupling devices. For example, bracket 64 may comprise one or more of a bolt 66, flat washers (e.g., M 10) 67, lock nuts (e.g., nylon) 68, a spacer 69, and/or other components and be used to couple piston 62 to arm 40 as shown in FIG. 6C.

FIG. 6D illustrates two end views 70, 71 of motor base bracket 65. As shown in FIG. 6D, in some implementations, motor 60 may be coupled to bracket 65 (and to frame 12—not shown in FIG. 6D) using various coupling devices. The coupling devices may include screws, nuts, bolts, adhesive, washers, fittings, bearings, slots, hooks, clamps, clips, nails, complimentary alignment features, friction fits, brackets, and/or other coupling devices. In the example shown in FIG. 6D, motor 60 is coupled to bracket 65 via a bolt 73, a lock nut 75, and/or other components.

FIG. 6E illustrates a side view of motor base bracket 65. As shown in FIG. 6E, in some implementations, bracket 65 may be configured such that motor 60 may be able to pivot relative to frame 12. FIG. 6E also illustrates how, in some implementations, bracket 65 may be coupled to frame 12 via one or more screws 77 and/or other coupling devices (e.g., as described herein).

In some implementations, linking member 36, arm 40, piston 62, and/or other components may form a linking assembly. The linking assembly may include all of these components, any two of these components, any one of these components, and/or other components. It should be noted that the description of arm 40, piston 62, and/or other components of actuator 22 and/or system 10 is not intended to be limiting. System 10, actuator 22, and/or the linking assembly may include any component or components configured to impart motion from motor 60 to piston 62, arm 40, linking member 36, cover panels 18, and/or other components. A piston an arm and a linking member are just three possible examples of such features. In some implementations, piston 62 and/or arm 40 need not be included in system 10, actuator 22, and/or the linking assembly at all. For example, motor 60 may be directly coupled to linking member 36. Motor 60 may be coupled to arm 40 without piston 62. Piston 62 may be coupled to linking member 36 without arm 40. Motor 60 may be coupled to linking member 36 via one or more components other than a piston and/or an arm. Piston 62, arm 40, linking member 36, and/or other components may form a single piece. In some implementations, a length and/or other dimensions of arm 40, linking member 36, and/or piston 62 may vary with and/or otherwise correspond to the dimensions of system 10 (FIG. 1). For example, arm 40, linking member 36, and/or piston 62 may have any dimensions that allow cover panels 18 to rotate as described. Other examples are contemplated.

Figure 7B:
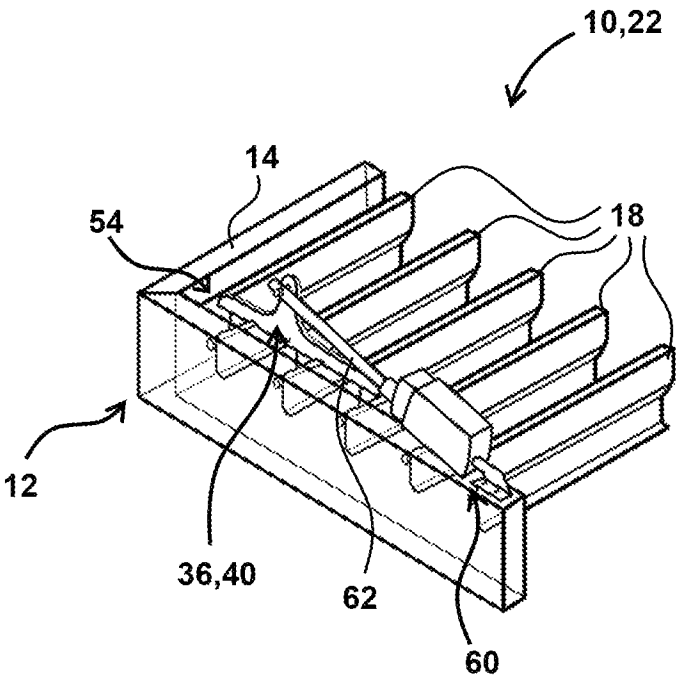
FIG. 7B illustrates the actuator with the cover panels in an open configuration, in accordance with one or more implementations.
Figure 7A:
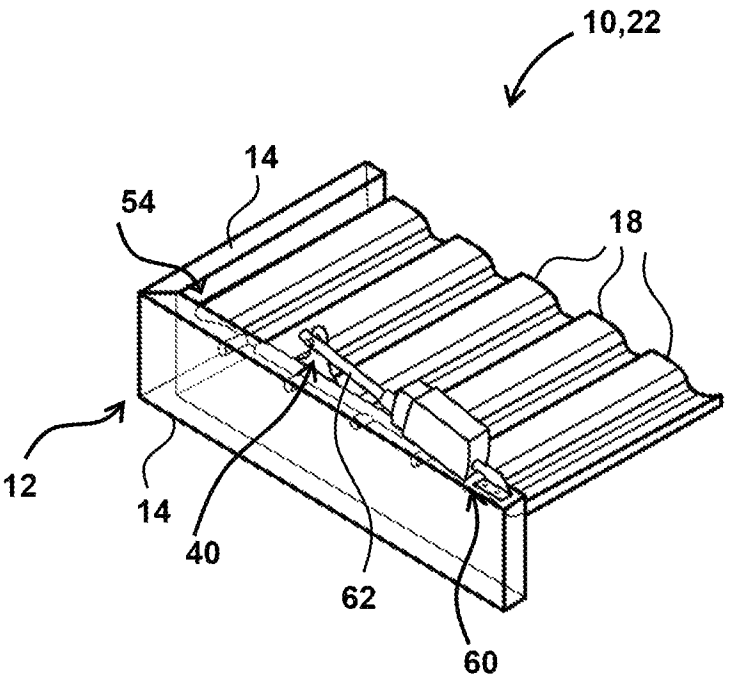
FIG. 7A illustrates an actuator of the present system with the cover panels in a closed configuration, in accordance with one or more implementations.

FIGS. 7A and 7B illustrate actuator 22 (e.g., motor 60, piston 62, arm 40, linking member 36, etc.) of system 10 mounted to frame 12, and coupled to cover panels 18. FIG. 7A illustrates actuator 22 with cover panels 18 in a closed configuration. FIG. 7B illustrates actuator 22 with cover panels 18 in an open configuration. As described above, linking member 36 (FIG. 7B) may be rotatably coupled to a plurality of individual link pins 31 (not visible in FIG. 7A or 7B) that extend from different ones of the cover panels 18. Linking member 36 may be configured to rotate panels 18 between the open configuration and the closed configuration via link pins 31. In some implementations, a given link pin extends from one side of a cover panel 18 at an end of the cover panel 18 such that at least a portion of linking member 36 and/or arm 40 changes height relative to frame 12 when cover panels 18 rotate between the open configuration (e.g., as shown in FIG. 7B) and the closed configuration (e.g., as shown in FIG. 7A).

As shown in FIGS. 7A and 7B, in some implementations, linking member 36 may be coupled to panels 18 at a gap 54 between corresponding ends of panels 18 and an edge of frame 12. Linking member 36 may be positioned in gap 54 when panels 18 are in the closed configuration (FIG. 7A). Linking member 36 may be positioned above gap 54 when panels 18 are in the open configuration (e.g., as shown in FIG. 7B).

As discussed above, arm 40 may be configured to couple with piston 62 at a location (e.g., location 52 as shown in FIG. 5B) above (e.g., relative to a ground or support surface) panels 18, linking member 36, frame 12, and/or other components of system 10 such that intended movement (e.g., pivoting as shown by comparing FIG. 7A to FIG. 7B) of piston 62 and/or motor 60 is not interrupted by panels 18, linking member 36, frame 12 and/or other components of system 10. In some implementations, motor 60 is pivotally coupled to frame 12 to allow motor 60, piston 62, and/or other components of actuator 22 and/or system 10 to pivot toward frame 12 when panels 18 rotate to the closed configuration (FIG. 7A), and pivot away from frame 12 when panels 18 rotate to the open configuration (FIG. 7B).

Returning to FIG. 1, in some implementations, patio cover system 10 may be assembled with various assembly operations. In some implementations, the assembly operations may be implemented via machining methods, and/or other manufacturing methods. In some implementations, one or more of the components of patio cover system 10 may be machined and/or otherwise formed from stock material. Machining may include stamping, pressing, heat treating, cutting, turning, milling, drilling, broaching, bending, and/or other machining operations. In some implementations, the general shapes of the components of patio cover system 10 may be formed by one or more of these processes, for example. In some implementations, the components of patio cover system 10 may be coupled together using various coupling devices. The coupling devices may include screws, nuts, bolts, adhesive, washers, fittings, bearings, slots, hooks, clamps, clips, nails, complimentary alignment features, friction fits, brackets, and/or other coupling devices.

The assembly operations described herein are intended to be illustrative. In some implementations, assembly may be accomplished with one or more additional operations not described, and/or without one or more of the operations discussed. Additionally, the order in which the assembly operations are is not intended to be limiting.

The assembly operations may include assembling frame 12. Frame 12 may be assembled using support beams 14, couplers, and/or other components. The assembly operations may include installing support posts 16 in or on a ground surface and coupling frame 12 to support posts 16. Support posts 16 may be vertically oriented, for example. In some implementations, support beams 14 may be horizontally oriented and supported by vertically oriented support posts 16. The assembly operations may include rotatably coupling cover panels 18 to support beams 14 (e.g., as described above). The assembly operations may include mounting actuator 22 to frame 12 and coupling actuator 22 to cover panels 18 (e.g., as described above). Cover panels 18 and/or actuator 22 may be coupled to support beams 14 and/or frame 12 before or after frame 12 is coupled to support posts 16.

Although the present technology has been described in detail for the purpose of illustration based on what is currently considered to be the most practical and preferred implementations, it is to be understood that such detail is solely for that purpose and that the technology is not limited to the disclosed implementations, but, on the contrary, is intended to cover modifications and equivalent arrangements that are within the spirit and scope of the appended claims. For example, it is to be understood that the present technology contemplates that, to the extent possible, one or more features of any implementation can be combined with one or more features of any other implementation.

What is claimed is:

1. A patio cover system, the system comprising:

a frame comprising support beams;

support posts configured to support the frame;

cover panels rotatably coupled to the support beams, wherein the cover panels are mounted in the frame at a non-parallel angle so that the cover panels tilt relative to the support beams; and an actuator mounted to the frame and coupled to the cover panels, the actuator configured to rotate the cover panels between an open configuration and a closed configuration, the actuator comprising:

a motor;

a piston coupled to the motor;

an arm coupled to the piston and configured to extend from the piston toward the cover panels; and a linking member coupled to the arm and the cover panels, the linking member configured to rotate the cover panels in unison between the open configuration and the closed configuration when driven by the arm, the piston, and the motor;

wherein:

the cover panels are mounted to the frame via rotation pins located at either end of the cover panels, the rotation pins located along axes of rotation of the cover panels, orifices in the support beams that receive the rotation pins are located closer to an upper surface of one of the support beams on a first side of the frame where the actuator is mounted and where the linking member operates, relative to a second, opposite side, of the frame, and the rotation pins on the first side of the frame have a longer length than the rotation pins on the second side of the frame to accommodate a gap between the cover panels and the frame that is larger on the first side of the frame than the second side of the frame because of the tilt.

2. The system of claim 1, wherein the linking member is rotatably coupled to a plurality of individual link pins that extend from different ones of the cover panels, the linking member configured to rotate the cover panels between the open configuration and the closed configuration via the link pins.

3. The system of claim 2, wherein the link pins extend from one side of the cover panels at an end of the cover panels such that a distance between a portion of the linking member and/or the arm and the frame changes when the cover panels rotate between the open configuration and the closed configuration.

4. The system of claim 2, wherein the rotation pins are separate from the link pins.

5. The system of claim 1, wherein each of the orifices comprises a bushing and a snap ring configured to receive and hold the rotation pins.

6. The system of claim 1, further comprising gutters coupled to the frame below the gap between the cover panels and the frame.

7. The system of claim 1, wherein the linking member is longer than the arm along a first axis, and the arm is longer than the linking member along a second, substantially perpendicular axis; and wherein the arm has a longer first end located toward the motor along the first axis relative to a shorter second, opposite, end of the arm.

8. The system of claim 1, wherein the cover panels are louvered.

9. The system of claim 1, wherein the motor is pivotally coupled to the frame to allow the motor to pivot toward the frame when the cover panels rotate to the closed configuration, and pivot away from the frame when the cover panels rotate to the open configuration.

10. The system of claim 9, wherein the piston and the arm are configured to pivot with the motor toward the frame when the cover panels rotate to the closed configuration, and pivot away from the frame when the cover panels rotate to the open configuration.

* * * * *